US005837133A

United States Patent [19]

Natale

[11] Patent Number: 5,837,133

[45] Date of Patent: Nov. 17, 1998

[54] METHOD AND APPARATUS FOR PREVENTING ALGAE GROWTH IN OPEN-TOPPED COOLING TOWER RESERVOIRS

[76] Inventor: John M. Natale, 1805 Brazos Dr., Corpus Christi, Tex. 75412

[21] Appl. No.: 811,433

[22] Filed: Mar. 3, 1997

[51] Int. Cl.[6] ..... B01F 3/04

[52] U.S. Cl. ..... 210/167; 52/66; 160/84.06; 210/232; 210/244; 220/730

[58] Field of Search ..... 220/730; 160/84.01, 160/84.06, DIG. 1; 52/66; 4/498, 503; 210/167, 232, 169, 244; 165/119, 134.1; 261/111, DIG. 11

[56] References Cited

U.S. PATENT DOCUMENTS

| | | | |
|---|---|---|---|
| 2,118,474 | 5/1938 | Morton | 160/84.06 |
| 3,354,472 | 11/1967 | Steinbeck | 4/503 |
| 3,593,757 | 7/1971 | Haynes | 4/498 |
| 3,854,149 | 12/1974 | Mischke | 4/498 |
| 3,964,781 | 6/1976 | Fenton | 160/84.06 |
| 5,025,513 | 6/1991 | Weissner | 4/498 |
| 5,259,078 | 11/1993 | Crandall | 4/498 |
| 5,348,692 | 9/1994 | Bickerstaff | 261/111 |
| 5,451,445 | 9/1995 | Wang | 160/84.06 |
| 5,546,615 | 8/1996 | Chamness | 4/498 |

*Primary Examiner*—Jay H. Woo
*Assistant Examiner*—Betsey J. Morrison
*Attorney, Agent, or Firm*—Crutsinger & Booth

[57] ABSTRACT

Disclosed is the method and apparatus for preventing algae growth in open-topped cooling tower reservoirs and the like which utilizes a porous flexible sheet material placed over the open top of the water reservoir, such sheet material characterized by the fact that it has an effective shade factor to prevent the growth of algae in the reservoir but is porous to allow cooling air—water interaction.

3 Claims, 3 Drawing Sheets

METHOD AND APPARATUS FOR PREVENTING ALGAE GROWTH IN OPEN-TOPPED COOLING TOWER RESERVOIRS

TECHNICAL FIELD

The present invention relates to improvements in an apparatus for preventing the growth of algae in cooling tower water and methods therefor.

BACKGROUND OF THE INVENTION

Cooling systems using water as a coolant are common in industrial applications such as power generation, air conditioning, and the like. The water is used to absorb and remove heat energy. The heat energy is dissipated from the water by evaporation in cooling towers. A common problem in cooling towers is undesirable algae growth in the cooling water as a result of the elevated temperature and exposure to sunlight. Algae build up is a common problem in exposed open-topped cooling water troughs. These troughs act as manifolds for cooling water to feed water to the evaporator surfaces of the cooling tower. Chemical methods of controlling algae are expensive and undesirable. Mechanical removal of algae from the exposed troughs is, likewise, undesirable. Roofs or tops placed over the open troughs inhibit heat transfer and are expensive.

SUMMARY OF THE PRESENT INVENTION

The present invention contemplates improved apparatus and methods for preventing algae growth in the exposed troughs associated with cooling towers and the like. The apparatus comprises placing a porous selective light filter over the troughs to prohibit algae growth while allowing beneficial cooling to occur. In one embodiment, the invention contemplates stretching taut cables at the edges of the elongated troughs that act as tracks for supporting porous filter material. Porous filter material consists of a flexible fabric in sheet form made of a polyester material with noncorrosive o-rings or the like attached along the side edge thereof to support the filters from the cable tracks. The filter material, although porous, is selected to have sufficient sunlight blocking characteristics to inhibit algae growth yet allowing water evaporation therethrough. The filter material is tensioned at end edges to stabilize the material over the open-top trough. The cable tracks allow the material to be slid along the tracks to open the troughs for service and repairs and can be easily returned to their covering position.

Thus, the present invention provides a inexpensive, easily accessible, effective, algae-preventing shield, which allows heat transfer.

DESCRIPTION OF THE DRAWINGS

The accompanying drawings are incorporated into and form a part of the specification to illustrate examples of the present invention. These drawings, together with the description, serve to explain the principles of the invention. The drawings are only for the purpose of illustrating preferred and alternate examples of how the inventions could be made, used, and are not to be construed as limiting the inventions to only the illustrated and described examples. The various advantages and feature of the present inventions will be apparent from a consideration of the drawings in which.

DETAILED DESCRIPTION

Figure 1:
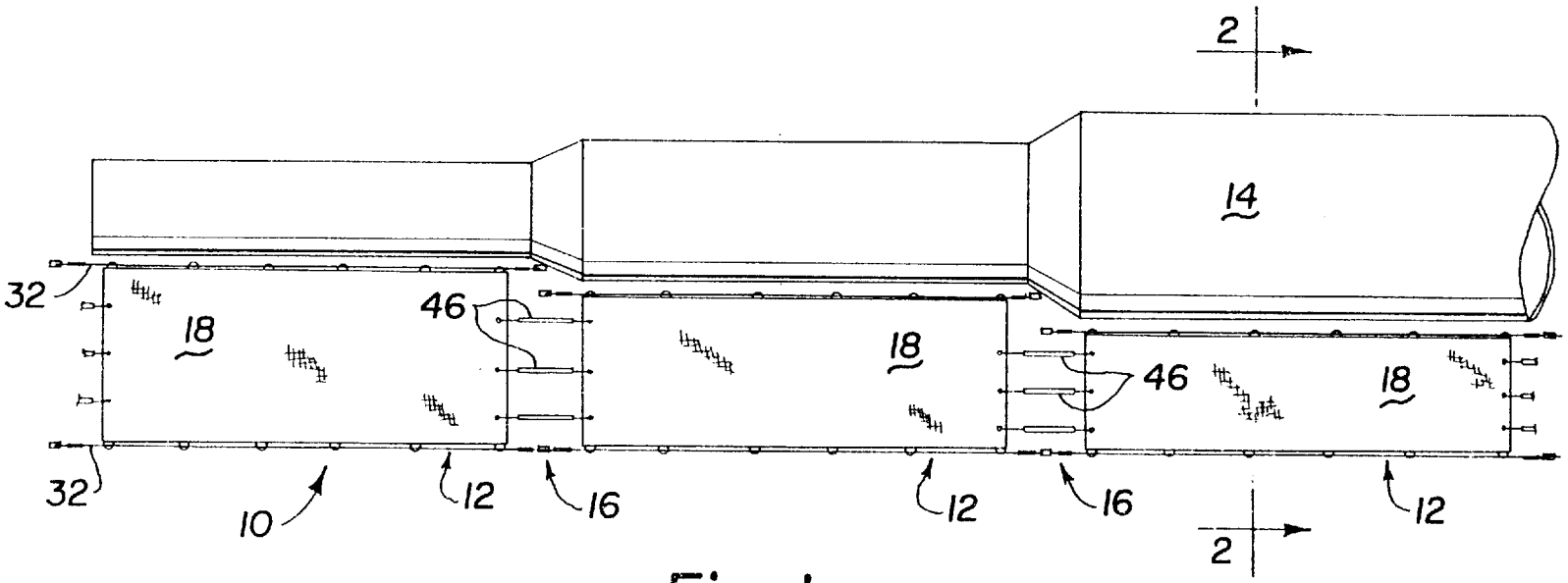
FIG. 1 is a top plan view of an example of a cooling tower tough configuration with an embodiment of the present invention installed therein.

The present invention will be described by referring to the drawings of the apparatus and methods showing various examples of how the inventions can be made and used. In the drawings, reference characters are used throughout the several views to indicate like or corresponding parts. In FIG. 1 one embodiment of the cover assembly 10 is shown in exemplary form to use to cover the open troughs 12 of the cooling water tower. It is to be understood, of course, that the cover assembly 10 can be used in other applications and in other configurations where open-topped reservoirs of water are utilized and in which the build up of algae is to be prevented.

In FIG. 1 a cooling tower is shown with a plurality of troughs 12 positioned along side of the cylindrical manifold 14. Manifold 14 is designed to distribute to the troughs 12 cooling water pumped to the top of the tower. The open-topped troughs 12 are aligned along the side of the manifold 14 to receive heated water from the manifold by passageways (not shown). Cooling water in troughs 12 are fed through passageway (not shown) to a lattice work or other air contact means to utilize the water to cool through evaporation. As shown, the ends of the troughs 12 can be separated by passage or access way 16.

In the embodiment shown, the troughs are rectangular in their plan view and open-topped to allow air-water contact at top of the trough. Each trough 12 has its own cover 18 the side shaped to fit over trough 12. Although the shape is not important, it is to be noted that the size and shape of covers 18 are perfectly selected to completely cover the open-top of the troughs 12.

Figure 2:
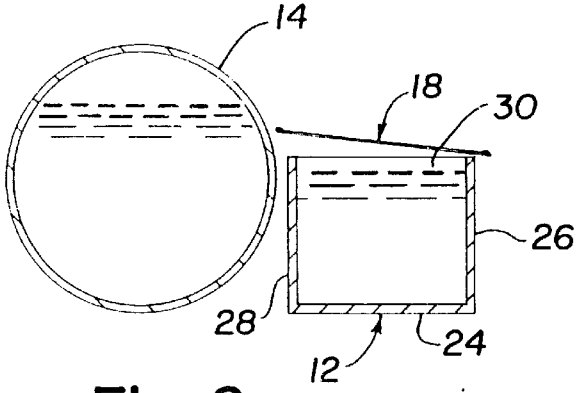
FIG. 2 is a partial sectional view taken on line 2—2 of FIG. 1 looking in the direction of the arrows.
Figure 3:
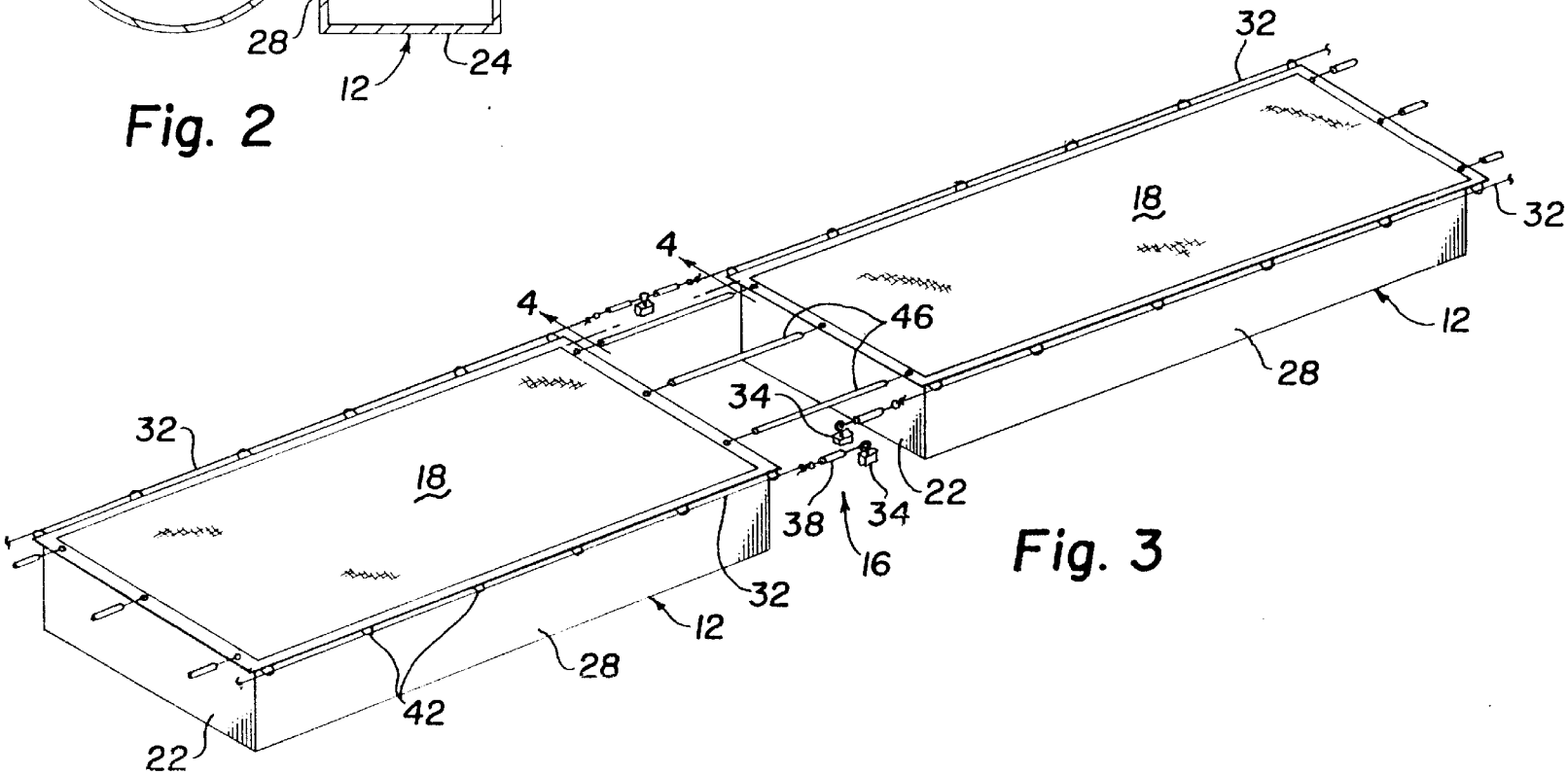
FIG. 3 is a perspective view illustrating the interrelationship between the two longitudinally aligned adjacent troughs and the covers therefor.

The details of the construction of covers 18 will be described by reference to FIGS. 2 and 3. For purposes of description, the end walls of the trough will be designated by reference number 22, the bottom wall by reference number 24 and the two elongated side walls by reference numbers 26 and 28. In the embodiment shown, the inside wall 28 is slightly higher than the outside wall 26. This causes the end walls 22 to be trapezoidal in shape. The open-top 30 is slightly inclined toward the outside wall 26. It is to be appreciated, of course, that cover 18 of the present invention has application of a trough with other shapes, such as: troughs with rectangular end walls, troughs of variable depth, troughs with semicylindrical cross sections and the like.

Figure 4:
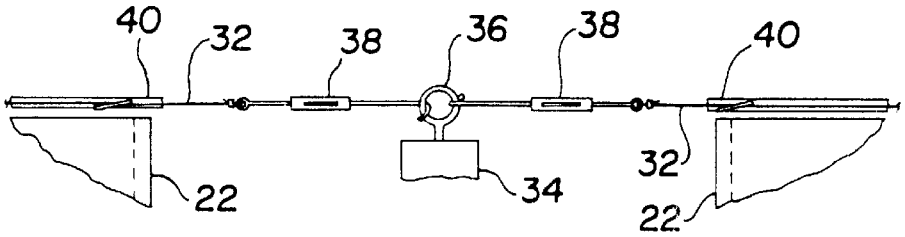
FIG. 4 is a sectional view taken on line 4—4 of FIG. 3 looking in the direction of the arrows.

Covers 18 are shown as being rectangular in shape and slightly larger in width and length than the open-top 30. At least parallel cables 32 are suspended and strung adjacent to the upper edge of the side walls 26 and 28. The ends of the cables 32 are strung from frames 34 positioned in the walkways 16. As shown in FIG. 4, an eye bolt 36 is mounted in frame 34. Cables 32 are connected to the eye bolt 36 by turnbuckles 38. It will be appreciated that turnbuckles 38 provide a means to maintain and adjust tension in the cables 32. Cables 32 provide support for the covers 18. It is to be appreciated that the cables should be tensioned sufficiently to support and control the covers 18 in the presence of a variety of weather conditions. At least a pair of parallel cables are used with each cover; however, more than two could be used.

In the preferred embodiment the cover 18 is formed from sheet mesh fabric material. The fabric is reinforced on its periphery by webbing material 40. Preferably, the size of the cover 18 is such that webbing 40 preferably does not overlay the open top 30. The plurality of noncorrosive D-rings 42 have been attached at spaced locations. The D-rings 42 are, as shown, spaced along the longer sides 26 and 24 of the trough 28 to support the fabric between the parallel cables 32. A plurality of noncorrosive grommets 44 are provided in the fabric along the shorter sides 22 of the trough 12 for use in longitudinally tensioning the fabric. In the embodiment shown, resilient members 46, such as springs or bunji cords, are connected to the grommets 44 to longitudinally tension the fabric over the open-topped trough. As shown in FIG. 3, preferably the eyelets of adjacent assemblies 18 are tensioned together across the space of walkway 16.

Figure 5:
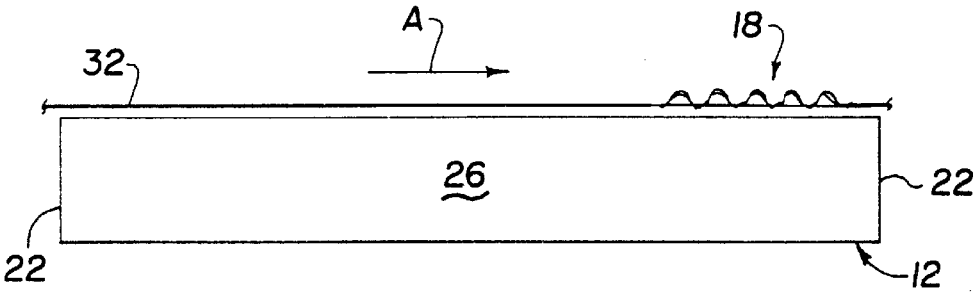
FIG. 5 is a side elevation view showing the cover in the retracted position.
Figure 6:
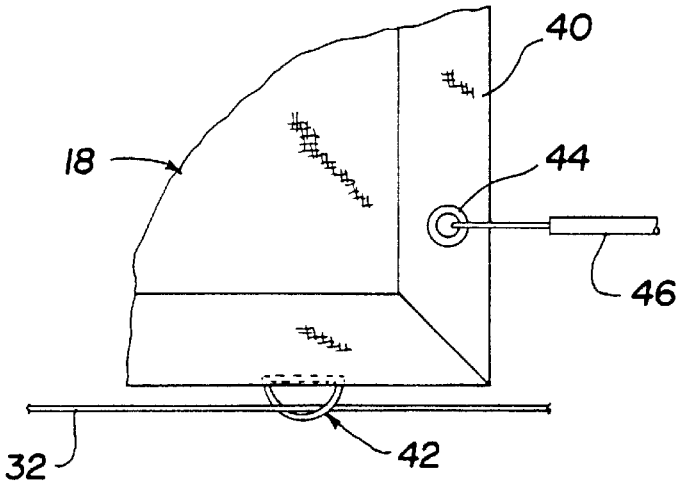
FIG. 6 is an enlarged partial plan view showing a corner portion of the corner.

By reference to FIG. 5 the method of using the cover assembly 10 will be described. As was previously described, the cover is first installed with the open top 12 at the trough 12 by suspending the cover 18 between two parallel support cables 32 after the cover is tensioned in position by members 46. When installed the cover is stretched over the open top and overlaps sides. When access to the interior or trough 12 is necessary for maintenance or the like, the cover can be easily moved out of the way as is shown in FIG. 5. The first step in removing the cable is to disengage or unhook the members 46 from the cover 18. The cover can then be moved out of the way along the cables 32 while the cables provide support for the cover and prevent it from falling into the trough opening. For example, in FIG. 5 the cover 18 is shown moved in the direction of arrow A to provide access to the interior of the trough. Cover 18 can be moved along the tracks completely out of the way of the trough or can be slid to one side as shown in FIG. 5.

In the embodiment shown, the mesh fabric is selected to be both porous and partially light blocking. The porosity improves heat transfer, the light blocking inhibits algae growth. In the preferred embodiment, the mesh fabric has an 80% (78% to 82%) shade factor. This factor has been found to be effective to prevent algae growth in the Southern climates of the United States. The shade factor as used herein is the percentage of normal directed light blocked by the fabric. A 40 to 50 millimeter thick fabric was selected with 9×8 ends/inch of 1000 denier polyester yard coated with flexible formed PVC. However, other fabrics are believed to be suitable.

For example, a 45 to 50 millimeter thick fabric, with 11×10 ends/inch polyester with a shade factor as high as 93% to 96% is believed suitable for algae blocking in lower latitudes yet still provides porous cooling. In Northern latitudes a shade factor as low as about 60% to 55% is believed to be effective to block algae growth. The embodiments shown and described above are only exemplary. Many details are often found in the art such as construction of turnbuckles, D-rings, and the details of cooling tower construction. Therefore, many such details are neither shown nor described. It is not claimed that all of the details, parts, elements, or steps described and shown were invented herein. Even though numerous characteristics and advantages of the present invention have been set forth in the foregoing description, together with the details of the structure and function of the inventions. The disclosure is illustrative only, and changes may be made in the detail especially in the manner of shape, size, and arrangement of the parts within the principles of the inventions to the full extent indicated by the broad general meaning of the terms used in the attached claims.

The description and drawings of the specific examples described above do not point out what an infringement of this patent would be but are to provide at least one explanation of how to make and use the inventions. Limits of the inventions and the bounds of the patent protection are measured by and defined in the following claims.

What is claimed:

1. An algae growth inhibiting liquid handling assembly comprising:

a trough for containing a volume of liquid, said trough having a generally rectangular cross section in the plan view and having a bottom, two ends, and two elongated sides, the upper edges of the sides and ends forming an open top, an algae growth inhibiting cover assembly of flexible porous sheet material for covering said open top of said trough, said cover assembly being generally rectangular with at least two parallel extending opposed elongated side edges of a length to substantially extend along said elongated sides of said trough and two end edges of a length to substantially extend along said ends of said trough, said sheet material having a porosity selected to produce a shade factor in the range of about 55% to 96%, said cover assembly being of a size and shape to substantially cover said open top of said trough, reinforcing webbing attached along at least a portion of the edges of said sheet material, connection means on the side edges of said cover assembly for supporting said cover assembly over said trough, said connection means comprising ring members connected along the side edges of said sheet material and along the end edges of said sheet material, said side edge members being mounted in the plane of said cover and positioned to extend from the side edges thereof, and support members mounting said cover in a position providing an unsupported span over the open top of said trough, said support members comprising at least two cables suspended in spaced parallel relationship along the length of said sides of said trough, said cables being in close proximity to the upper edges of the sides of the trough, said side edge members being connected to said cables in sliding engagement to support said cover from said cables, said cover being connected to said cables to be moved between a first position wherein said cover is positioned substantially over said open top and a second position wherein said cover is moved along said parallel cables to a position away from at least a portion of the open top of said trough to allow unrestricted access to said trough, members engaging said end edge ring members to hold said sheet material in position over the open top of the trough.

2. The assembly of claim 1 wherein said side edge ring members are D-rings.

3. The assembly of claim 1 wherein said end edge ring members are grommets.

* * * * *